US006065401A

United States Patent [19]

Marmin

[11] Patent Number: 6,065,401

[45] Date of Patent: May 23, 2000

[54] DEVICE FOR JOINING MATERIAL WEBS DURING THE OPERATION OF A WEB-FED ROTARY PRESS

[75] Inventor: Jean Claude Marmin, Estrees-Saint-Denis, France

[73] Assignee: Heidelberger Druckmaschinen AG, Heidelberg, Germany

[21] Appl. No.: 09/120,606

[22] Filed: Jul. 22, 1998

[30] Foreign Application Priority Data

Jul. 22, 1997 [FR] France ..... 97 09270

[51] Int. Cl.[7] ..... B41F 13/56

[52] U.S. Cl. ..... 101/228; 242/554.1; 242/554.4; 242/556

[58] Field of Search ..... 101/228, 225; 226/11; 242/556, 556.1, 554.1, 554.2, 554.4, 555.5

[56] References Cited

U.S. PATENT DOCUMENTS

| | | | |
|---|---|---|---|
| 2,239,971 | 4/1941 | Pondorf | 242/554.1 |
| 2,812,145 | 11/1957 | Meloche | 242/556.1 |
| 2,957,637 | 10/1960 | Hosken . | |
| 3,042,332 | 7/1962 | Astley | 242/554.1 |
| 3,161,367 | 12/1964 | Goddard | 242/554.4 |
| 3,861,612 | 1/1975 | Kubo | 242/556.1 |
| 4,575,017 | 3/1986 | Pali | 242/556.1 |
| 4,846,060 | 7/1989 | Proctor . | |
| 5,377,586 | 1/1995 | Matsuno | 101/228 |
| 5,423,496 | 6/1995 | Röder | 242/555.5 |
| 5,615,610 | 4/1997 | Prohaska . | |
| 5,709,355 | 1/1998 | Kinnunen et al. | 242/556.1 |

FOREIGN PATENT DOCUMENTS

| | | | |
|---|---|---|---|
| 0416389A2 | 3/1991 | European Pat. Off. . | |
| 0654433A1 | 5/1995 | European Pat. Off. . | |
| 2354952 | 1/1978 | France . | |
| 777576 | 6/1957 | United Kingdom | 242/556.1 |
| 1135623 | 12/1968 | United Kingdom | 101/228 |
| 1260182 | 1/1972 | United Kingdom . | |

*Primary Examiner*—Eugene Eickholt
*Attorney, Agent, or Firm*—Herbert L. Lerner; Laurence A. Greenberg; Werner H. Stemer

[57] ABSTRACT

An emergency web-joining device activatable when a break occurs in a paper web disposed in operating condition in a rotary printing press, includes an unwinder having a paper web supply wound thereon, the unwinder being disposed in the vicinity of a roll for guiding a previously printed paper web, the supply of paper web and the previously printed paper web being joinable to one another in order to maintain passage of the previously printed web through a press part located downstream of the unwinder.

4 Claims, 3 Drawing Sheets

DEVICE FOR JOINING MATERIAL WEBS DURING THE OPERATION OF A WEB-FED ROTARY PRESS

BACKGROUND OF THE INVENTION

1. Field of the Invention

The invention relates to a device for joining material webs during the operation of a web-fed rotary press and, more particularly, to an emergency material web-joining device which is activated when a paper web becomes broken or torn during the operation of a rotary printing press.

The published European Patent Document EP 0 654 433 A1 describes a device for preventing damage when material webs become broken or torn in a rotary printing press. With a device of this type, it is possible, through the use of control clutches, to prevent damage caused by the torn or broken webs to production devices, including rotating cylinders, such as printing blanket cylinders of the rotary printing press. According to the teaching of this document, the paper web runs partly around a rotatably mounted guide roll, and rollers are provided to clamp the web to this roll, which is controlled in the paper web travel direction by a control clutch.

With this heretofore known device, the cylinders of the printing unit can be protected effectively if a web should tear or break; however, the torn or broken web can slide out unimpeded from a cooling roll section arranged downstream of the dryer or can run out of a superstructure of turner or angle bars.

2. Summary of the Invention:

It is accordingly an object of the invention to provide a device for joining material webs during the operation of a web-fed rotary press, the device being a new emergency device wherein, following a paper web break or tear in a printing press, it is possible to maintain the travel of a paper web which has been threaded into components of the rotary printing press.

With the foregoing and other objects in view, there is provided, in accordance with the invention, an emergency web-joining device activatable when a break occurs in a paper web disposed in operating condition in a rotary printing press, comprising an unwinder having a paper web supply wound thereon, the unwinder being disposed in the vicinity of a roll for guiding a previously printed paper web, the supply of paper web and the previously printed paper web being joinable to one another in order to maintain passage of the previously printed web through a press part located downstream of the unwinder.

In accordance with another feature of the invention, the unwinder is disposed in relation to the printed paper web in a manner that the paper web supply and the printed paper web are supportable on one another.

In accordance with a further feature of the invention, the unwinder is mounted in a pivotable holder.

In accordance with an added feature of the invention, the web-joining device includes a positioning element for bracing the paper web supply on the printed paper web.

In accordance with an additional feature of the invention, the positioning element is a cylinder controllable by a pressure medium.

In accordance with a particular feature of the invention, the cylinder is controllable pneumatically.

In accordance with an alternative feature of the invention, the cylinder is controllable hydraulically.

In accordance with yet another feature of the invention, the unwinder occupies a position sideways from the printed paper web and is mounted at a smallest possible distance therefrom.

In accordance with yet a further feature of the invention, the paper web supply is provided with adhesive at locations on a side thereof facing towards the printed paper web.

In accordance with yet an added feature of the invention, the locations at which the adhesive is provided are spaced apart from one another over the width of the paper web supply.

In accordance with yet an additional feature of the invention, the adhesive is located substantially in a central part of the paper web supply, the central part being disposed beyond the paper web supply wound on said winder.

In accordance with another feature of the invention, the web-joining device includes a drive assigned to the unwinder for accelerating the paper web supply wound thereon.

In accordance with a further feature of the invention, the drive engages with the outer circumferential surface of the paper web supply wound on the unwinder.

In accordance with an alternative feature of the invention, the drive engages directly with a spindle of the unwinder.

In accordance with another aspect of the invention, there is provided in a rotary printing press having a cooler including a group of cooling rolls, a web-joining device positioned in the group of cooling rolls, the unwinder of the web-joining device being disposed in the vicinity of one of the cooling rolls so as to maintain free passage of the paper web in and downstream of the cooler.

In accordance with a further aspect of the invention, there is provided in a rotary printing press having a superstructure of turner bars, a web-joining device positioned in the superstructure of turner bars, the unwinder of the web-joining device being disposed in the vicinity of one of the turner bars so as to maintain free passage of the paper web in and downstream of the superstructure.

In accordance with a concomitant aspect of the invention, there is provided in a rotary printing press having a folding machine, a web-joining device positioned in the folding machine, the unwinder of the web-joining device being arranged in the vicinity of a roll disposed on the folding machine so as to maintain free passage of the paper web in and downstream of the folding machine.

A particular advantage of the invention is that, upon the occurrence of a sudden paper web break in the press, a part of the web that is to be processed in the press can remain in the threaded state, in particular, that part of the web which is located in the regions that are most difficult to attain access to from the outside. By extremely rapid positioning of the unwinder in the ready-to-use position in the press, which is braked upon the occurrence of a web break, it is possible to employ the idling operation of the rotating press, which at most lasts only a few seconds, so as to join the supply web to the previously printed web. During the idling operation of the rotating press, the joined webs, namely the previously printed web and the unprinted web, are guided through the components of the press, such as the cooling roll section, the superstructure of turner bars and the former of the folding machine, so that the paper web can continue to be guided through these components. The passageway or travel path of the paper web, at least in one part of the press, is thus saved, and the press can be restarted and run up to operating speed very rapidly.

According to further features of the emergency web-joining device of the invention, the unwinder is positioned in relation to the printed paper web in such a manner that the supply paper web and the printed paper web can, if necessary, be supported or braced on one another, and the web can run through unimpeded during normal operation. The unwinder can be mounted on a pivotable holder, and the paper web supply can be brought into contact with the paper web running through the use of a positioning element. The positioning element may be formed as a cylinder controllable by a pressure medium. When not in operation, the unwinder is disposed at a smallest possible distance from the travel or passage plane of the printed web, in order to ensure rapid joining of the supply web and the printed web part, which runs by in the region wherein the unwinder is disposed. The travel distance required for the positioning of the paper web supply into the ready-to-use position is thus extremely short. The paper web supply is provided with adhesive, such as adhesive tapes or the like, on the side thereof facing towards the printed paper web. The adhesive may be applied at locations spaced from one another over the width of the supply paper web, or centrally and along the travel direction of the web.

The speed of the unwinder, which is provided with the supply paper web, is accelerated to the speed of the press and maintained thereat by a control which is assigned to the unwinder, so as to ensure the smoothest possible joining of the unprinted supply paper web to the printed paper web in the event of a break in the latter. The control can engage with the outer circumference of the wound-up supply web with the aid of a drive belt; equally well, the control can act directly upon the spindle of the unwinder. Both forms of controls are constructed for matching the rotational speed, in order to compensate for the change in diameter of the wound-up supply web on the unwinder.

The emergency web-joining device can advantageously be positioned at the exit from the dryer, i.e., in the cooling roll unit, or at the entry to the superstructure of turner bars of the rotary printing press. It may otherwise be disposed at the exit from this superstructure, above the first longitudinal folding device of the folding machine, or in the interior of the latter.

The unwinder of the emergency web-joining device can be positioned in the vicinity of one of the cooling rolls, in order to maintain the passage of the paper web within and downstream from the cooler or, viewed more generally, above the cut-off roll at the entry to the superstructure of turner bars.

The unwinder of the emergency web-joining device can likewise be positioned in the vicinity of a turner bar, in order to preserve the passageway for the paper web in the event of a web break in and downstream of the superstructure of turner bars. Furthermore, the unwinder of the emergency web-joining device can be arranged in the vicinity of a roll that is mounted on the folding machine, in order to keep free the passageway for the paper web in and downstream of the folding machine.

Other features which are considered as characteristic for the invention are set forth in the appended claims.

Although the invention is illustrated and described herein as embodied in a device for joining material webs during the operation of a web-fed rotary press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
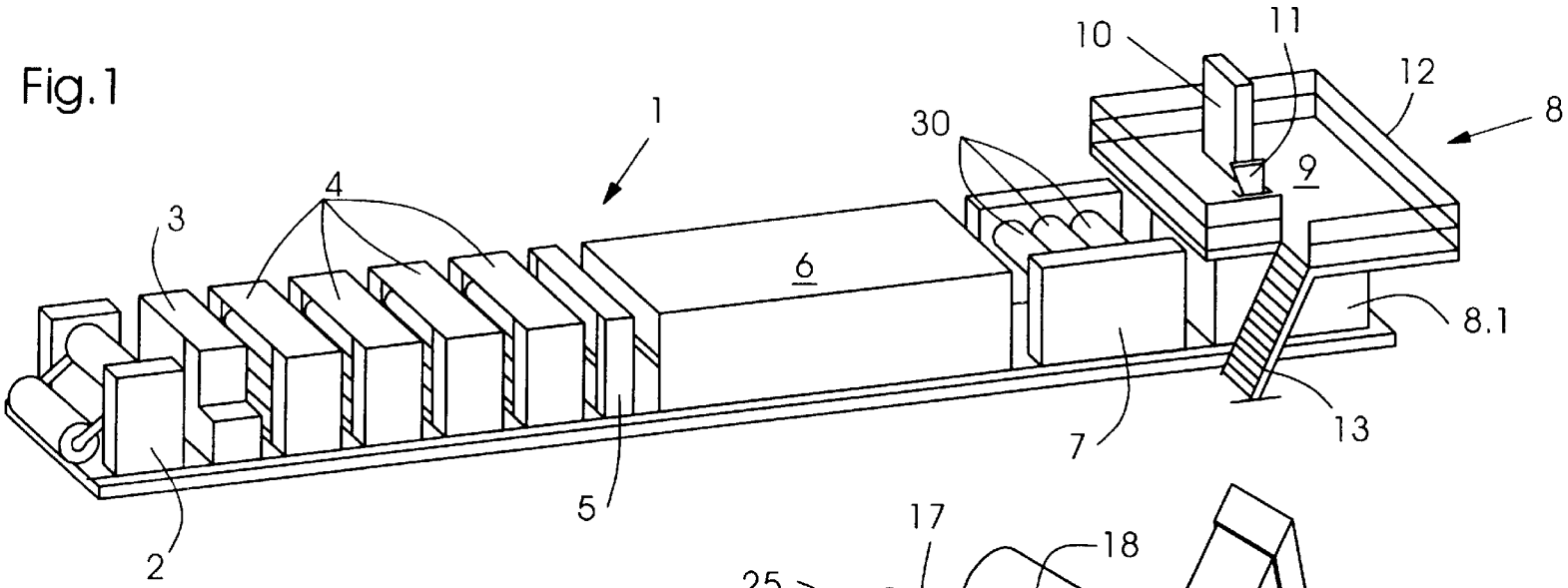
FIG. 1 is a diagrammatic front, right-hand side and top perspective view of a rotary printing press.

Referring now to the drawings and, first, particularly to FIG. 1 thereof, there is illustrated therein a rotary printing press 1 including a mill roll or paper reel changer 2, downstream from which there is a threading or infeeding mechanism 3. The changer 2 may contain a vertically or horizontally arranged magazine, wherein it is possible to provide a plurality of reel changers 2 which, depending upon the specific construction of the printing press, are mounted in tandem or in parallel. A plurality of printing groups or units 4, wherein the paper web can be printed on one or both sides thereof, adjoin or follow the threading or infeeding mechanism 3 in the travel direction of the web. A web-catching device 5 is located upstream of the dryer 6, which is followed downstream by an assembly 7 of a plurality of successive rotatably mounted cooling rolls 30.

A folding machine 8 having a cylinder part 8.1 adjoins the assembly 7 of cooling rolls 30 downstream therefrom. A platform 9, by which access is attained to the superstructure 10 of turner bars located thereabove, is disposed above the cylinder part 8.1 of the folding machine 8. A number of turner bars and other deflection members are mounted in this superstructure 10, in order to form very different paths of products which are to be folded individually. The platform 9 is provided with a railing 12 and can be reached from the floor via a stairway access 13. A former 11, through which the paper web is guided into the cylinder part 8.1 of the folding machine 8, wherein further processing or treatment of the paper web is continued, is located under the superstructure 10, which is illustrated only diagrammatically in FIG. 1.

Figure 2:
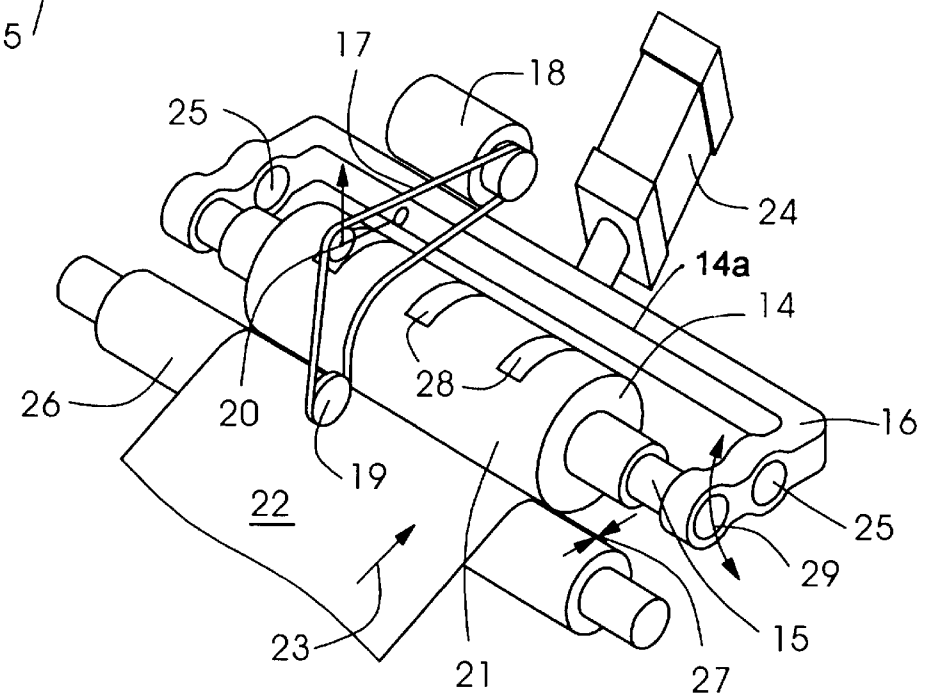
FIG. 2 is an enlarged fragmentary front, right-hand side and top perspective view of FIG. 1, illustrating an embodiment of an emergency device for joining material webs during the operation of the press in accordance with the invention.

As can be seen in FIG. 2, the emergency material-web joining device according to the invention includes an unwinder 14 having a paper-web supply 21 wound thereon, the unwinder 14 being mounted in a pivotable holder 16. The winding of the supply web 21 on the unwinder 14 forms a small reel 14*a*. The small reel 14*a* may be an end portion of a reel having a smaller web supply than that of a full reel. The small reel 14*a* is rotatably mounted in the holder 16 by a spindle 15. A positioning element 24, such as a pneumatic or hydraulic cylinder, for example, is able to cause the holder 16 to turn about pivots 25 in the directions of the double arrow 29. The positioning element 24 is operatable by supplying a pneumatic or hydraulic pressure medium thereto. A supporting or bracing of the unprinted supply web 21 of the small reel 14*a* can be performed very rapidly in order to ensure timely joining thereof to a printed web 22. In this regard, the small reel 14*a*, when in a rest position thereof, is located at only a very slight distance 27 from the traveling or running printed web 22. Therefore, the travel required to support or brace the supply web 21 on the running printed web 22 is extremely short.

The rotatably mounted small reel 14*a* is provided with adhesive 28 for joining the supply web 21 to the printed web 22. The adhesive 28 may be applied at different locations spaced apart from one another over the width of the supply web 21, or may also be in the form of individual adhesive tapes, for example, of the type adhering on both sides thereof, which are fastened in the center of that side of the supply web 21 located on the circumferential surface of the small reel 14*a* of the supply web 21 and facing towards the printed paper web 22. It is also possible, however, to use an adhesive 28 which can be applied over the width of the supply reel 14*a* in the form of individual continuous strips. In addition, it would be possible to provide a device for applying a liquid adhesive to the printed web 22 or to the supply web 21.

As can be seen in FIG. 2, a control device 17, 18, 19, 20 which is provided on the pivotable holder 16 permits the supply web 21, which is unwound at press speed, i.e., at the paper web travel or running speed, to be accelerated, and subsequently permits this speed to be maintained. The control device 17 to 20 includes a control member 18, such as an electric motor or the like, which is fastened to the holder 16 and acts upon one or more drive belts 17 which, for their part, are guided on turner rollers 19 and on tensioning rollers 20. The tensioning roller 20 is able to compensate for the original pull or tension of the drive belt or belts 17 on the circumference of the small roll 14*a*, as well as the continuously changing tensioning force resulting therefrom. When a web breaks or tears, and the supply web 21 is braced or supported on the printed web 22, the diameter of the small reel 14*a* decreases rapidly, because the paper webs 21 and 22, which are then joined, run or travel continuously through the other components, such as the assembly 7 of cooling rolls 30 and the superstructure 10 of turner bars or the folding former 11, in order to avoid losing the paper web travel 38 (note FIGS. 4*a*, 4*b* and 4*c*).

Instead of having a control device 17 to 20 act upon the outer circumference of the wound-up supply web 21, the spindle 15 of the unwinder 14 can be driven directly. This control device 17 to 20 then matches the speed of the small reel 14*a* to the rapidly decreasing diameter of the small reel 14*a*, i.e., the control member 18 forcibly drives the small reel 14*a* at a stepwise increasing speed in order to ensure a constant unwinding of the supply web 21.

The holder 16 of the small reel 14*a* is arranged opposite a guide roll 26, whereon the previously printed paper web 22 runs. If a support or bracing action is triggered by a break or tear in the printed web, the small reel 14*a* becomes braced or supported on the guide roll 26 whereon the printed web 22 runs, so that a connection or joint between the printed web 22 and the unprinted supply web 21 can be assured. It is therefore certain that the supporting or bracing movement of the small reel 14*a* does not fall into empty space, but rather, lands on the printed paper web 22. The arrow 23 indicates the original travel or running direction of the printed paper web 22 on the path 38 thereof (note FIGS. 4*a*, 4*b* and 4*c*).

Figure 3:
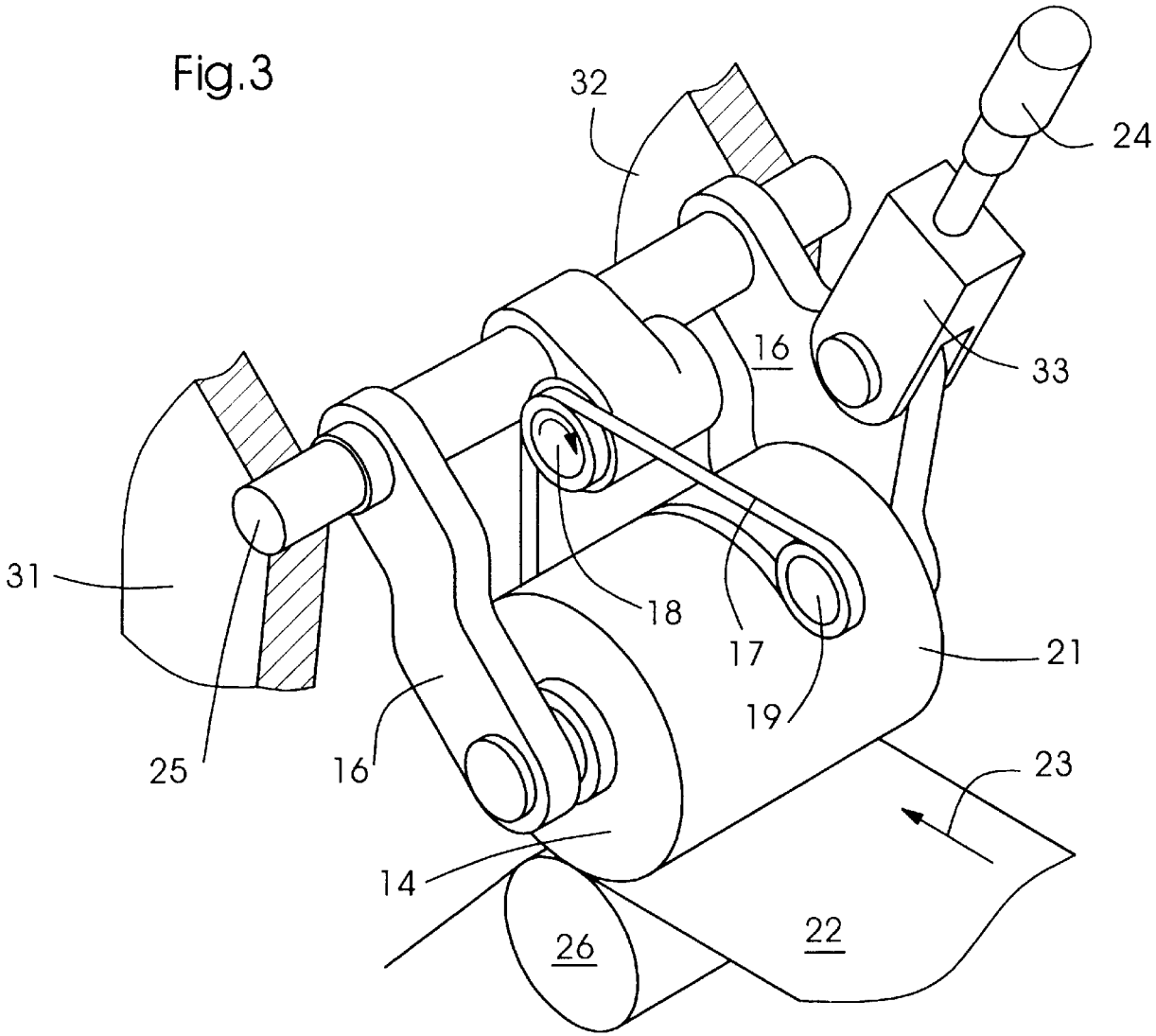
FIG. 3 is a further enlarged front, left-hand side and top perspective view of FIG.2 illustrating a different embodiment of the assembly of the emergency material-web joining device according to the invention.

According to the construction illustrated in FIG. 3, the unwinder 14 is mounted on a pivot shaft or pivots 25 which, in turn, is or are mounted or journalled in lateral flanges 31 and 32. The latter, which are indicated merely diagrammatically in the drawing of FIG. 3, may be lateral dividing walls or the cover either of a dryer 6, of the assembly 7 of the cooling rolls 30 or of the platform 9. The unwinder 14, which is provided with a wound-up supply web 21, can also be mounted on the folding machine 8 or on the former of the first longitudinal folding device 11. In the illustration according to FIG. 3, the unwinder 14 is shown mounted in the holders 16, one of which is connected by a fork 33 to the cylinder 24. The latter is suitably provided with a non-illustrated piston which can be driven pneumatically or hydraulically, as mentioned hereinbefore. Although it is not expressly illustrated in FIG. 3, the small reel 14*a*, when in the rest position, is located at a slight distance from the printed web 22, which runs on the guide roll 26 in the direction represented by the arrow 23. In this embodiment, the control device 17, 18, 19 partly engages with the circumference of the small reel 14*a* and entrains it therewith. The control member 18 ensures that the small reel 14*a* be brought to the speed of the press and maintained thereat. In the event of a web break or tear, the movement to brace or support the supply web 21 on the printed web 22, and the joining of the two webs 21 and 22, occurs immediately. The threading of the then joined webs 21 and 22 into the assembled group 7 of cooling rolls 30 and into the superstructure 10 of turner bars, including into the first longitudinal folding device 11, occurs during the period in which the press is decelerated, i.e., within the time interval that elapses before the press is fully braked and brought to a standstill. The travel 38 of the paper web, the threading of which was awkward, is thus maintained. Consequently, it is possible to restart the press much more rapidly.

The functioning of the emergency device for joining the paper webs during press operation in accordance with the invention is explained hereinafter in greater detail with reference to FIGS. 4*a* to 4*c*.

Figure 4A:
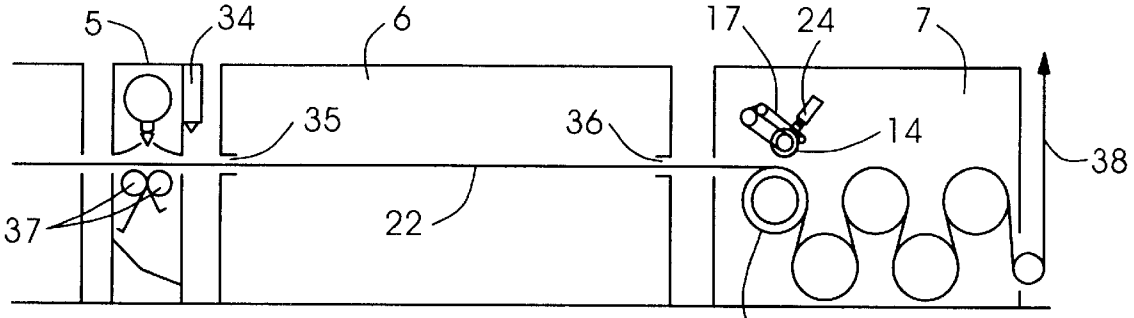
FIG. 4*a* is a slightly enlarged, fragmentary side elevational view of FIG. 1 showing a paper web, which is guided through a dryer and a cooling-roll section of the printing press.
Figure 4B:
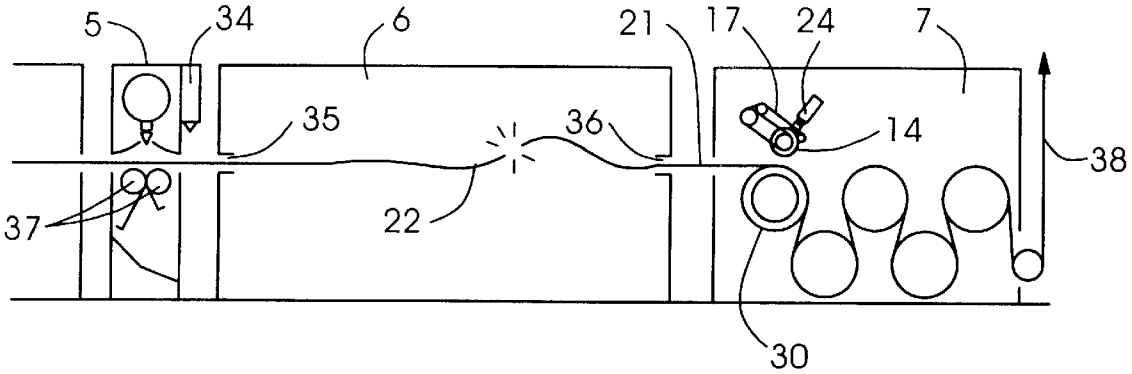
FIG. 4*b* is a view like that of FIG. 4*a* showing another operating phase of the printing press wherein a web break or tear has occurred, which results in a sudden loss of the web tension.
Figure 4C:
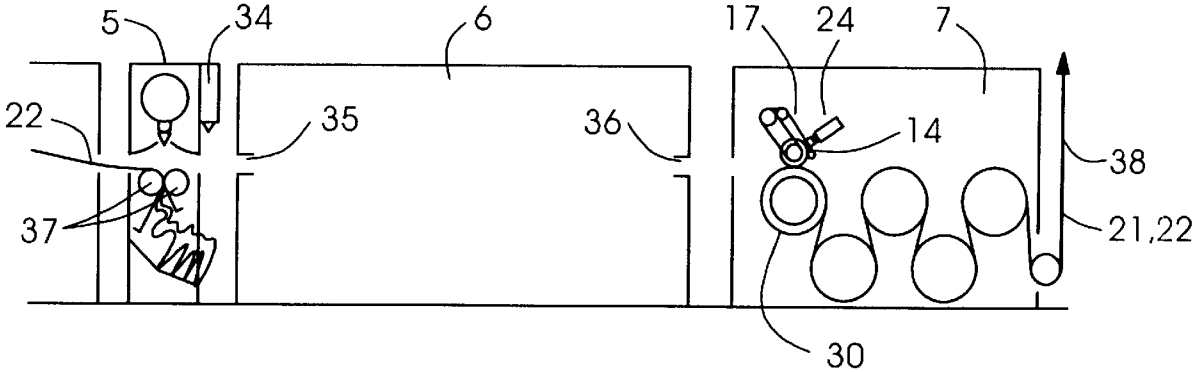
FIG. 4*c* is another view like those of FIGS. 4*a* and 4*b* showing a further operating phase of the printing press wherein the emergency material-web joining device according to the invention is disposed in a ready-to-use position, wherein the paper web travel is maintained in the cooling-roll section and in the adjacent superstructure of turner bars.

A web catching device 5 arranged downstream from the last of the printing units 4, a dryer 6 having a continuous passageway for the paper web and, for example, an assembled group 7 of cooling rolls 30 are illustrated in the series of FIGS. 4*a* to 4*c*. The paper web passageway, which is identified by reference numeral 38, leads into the superstructure 10 of turner bars which, as indicated diagrammatically in FIG. 1, is located above a first longitudinal folding device 11 which, in turn, is disposed above a folding machine 8. In the particular embodiment illustrated in FIGS. 4*a*, 4*b* and 4*c*, the small reel 14*a* of the emergency device for joining the paper webs according to the invention is mounted opposite a first cooling roll 30 of the assembled group 7 thereof, and the cylinder 24 and the control unit 17 are assigned to the emergency web-joining device. The web catcher 5, which is mounted upstream of the dryer 6, includes a pair of rolls 37, as well as a storage and disposal box for spoilage or rejected paper web. A detector 34, which is assigned to the web catching device 5, detects the occurrence of a web break and causes the paper web supply 21 to be braced or supported on the previously printed web 22. The dryer 6 is provided with entry and exit openings 35 and 36 through which the printed web 22 passes. In the operating phase of the equipment illustrated in FIG. 4*a*, the printed web 22 is running at press speed, such as 10 m/s, for example. The small reel 14*a*, which is arranged above the first cooling roll 30, is running at a speed which enables the webs 21 and 22 to be joined without delay during the operation of the rotary printing press at printing speed. This is important in order to avoid a break or tear in the supply web 21 downstream from the joining point of the webs 21 and 22 due to the sudden occurrence of tensile forces at the end of this joining process. If a break or tear should occur, as indicated in FIG. 4*b*, the web tension or pull is abruptly slackened. The detector 34 switches the web catching device 5 on immediately, and a braking of the printing press, which is triggered by the occurrence of the breaking or tearing of the web, enables the web supply 21 to continue to travel within a transition interval of a few seconds, the web supply being guided into the spoilage or reject container located upstream of the passage through the dryer 6, as also shown in FIG. 4*c*. The pair of rolls 37 arranged in the web catching device 5, and the spoilage or reject container located underneath the latter are provided for this purpose.

Upon the occurrence of the web break, the press is braked for about six seconds until it comes to a standstill. At a web speed of about 10 m/s, it is possible for up to a further 40 m of web to be introduced into the machine during this time interval. The torn part of the printed web 22 continues to be guided on the driven cooling rolls into the superstructure of turner bars and into the first longitudinal folding device 11, and is then removed from the paper passage 38 if no precautionary measures are taken. The unwinder 14, which is provided with the supply web 21 and is switched on by the detector 34, is brought into contact with the printed web 22 immediately after the occurrence of the web break; the adhesive 28 located on the circumference of the small reel 14*a* permits the supply web 21 to be joined adhesively to the printed web 22; the idling movement of the cooling rolls 30 of the assembly group 7 and that of the pull rolls located in the superstructure 10 of turner bars then lead the joined webs 21 and 22 around these rolls 30 and along the path of the paper web passageway 38 into the superstructure 10 and into the first longitudinal folding device until the press comes to a standstill. Although there is no longer any web in the dryer 6, the webs 21 and 22 remain along the paper passageway 38 in the assembly group 7 of cooling rolls 30 as far as the folding former 11. The paper web passageway 38 is thus maintained in those components of the press which are difficult to access, such as in the assembled group 7 of cooling rolls 30 or the superstructure 10 of turner bars, as well as in the folding former 11, without requiring any Laborious re-threading of the web or the webs into these components.

The emergency web-joining device according to the invention can be arranged not only on the assembled group 7 of the cooling rolls 30 but also on the dryer 6 at the exit from the superstructure 10 of turner bars, as well as in the folding machine 8, above the folding former 11.

What is claimed is:

1. An emergency web-joining device activatable when a break occurs in a paper web disposed in an operating condition in a rotary printing press, comprising:

an unwinder having a paper web supply wound thereon, said unwinder being disposed in the vicinity of a roll for guiding a printed paper web, the paper web supply and the printed paper web being Joinable to one another in order to maintain passage of the printed paper web through a press part located downstream of said unwinder;

said unwinder disposed in relation to the printed paper web in a manner that the paper web supply and the printed paper web are supportable on one another;

said unwinder disposed sideways from the printed paper web and mounted closely adjacent thereto.

2. An emergency web-joining device activatable when a break occurs in a paper web disposed in an operating condition in a rotary printing press, comprising:

an unwinder having a paper web supply wound thereon, said unwinder being disposed in the vicinity of a roll for guiding a printed paper web, the paper web supply and the printed paper web being joinable to one another in order to maintain passage of the printed paper web through a press part located downstream of said unwinder; and a drive assigned to said unwinder for accelerating the paper web supply wound thereon, the paper web supply having an outer circumferential surface, said drive engaging the outer circumferential surface of the paper web supply.

3. An emergency web-joining device activatable when a break occurs in a paper web disposed in an operating condition in a rotary printing press, comprising:

an unwinder having a paper web supply wound thereon, said unwinder having a spindle and being disposed in the vicinity of a roll for guiding a printed paper web, the paper web supply and the printed paper web being joinable to one another in order to maintain passage of the printed paper web through a press part located downstream of said unwinder; and a drive assigned to said unwinder for accelerating the paper web supply wound thereon, said drive directly engaging said spindle of said unwinder.

4. An emergency web-joining device activatable when a break occurs in a paper web disposed in an operating condition in a rotary printing press, comprising an unwinder having a paper web supply wound thereon, said unwinder being disposed in the vicinity of a cooling roll of a cooler, the cooling roll being for guiding a printed paper web, the paper web supply and the printed paper web being joinable to one another in order to maintain passage of the printed paper web through a press part located downstream of said unwinder.

* * * * *